US010400982B2

(12) United States Patent
Suzuki et al.

(10) Patent No.: US 10,400,982 B2
(45) Date of Patent: Sep. 3, 2019

(54) LIGHT SOURCE MODULE AND LAMP USING THE SAME

(71) Applicant: KOITO MANUFACTURING CO., LTD., Tokyo (JP)

(72) Inventors: Tetsuya Suzuki, Shizuoka (JP); Yukihiro Onoda, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 237 days.

(21) Appl. No.: 15/386,811

(22) Filed: Dec. 21, 2016

(65) Prior Publication Data

US 2017/0175970 A1 Jun. 22, 2017

(30) Foreign Application Priority Data

Dec. 22, 2015 (JP) ..... 2015-249349

(51) Int. Cl.

| | |
|---|---|
| ***F21V 29/00*** | (2015.01) |
| ***F21S 45/47*** | (2018.01) |
| ***F21S 41/19*** | (2018.01) |
| ***F21S 41/14*** | (2018.01) |
| ***F21S 45/43*** | (2018.01) |
| ***F21S 41/16*** | (2018.01) |
| *F21Y 115/30* | (2016.01) |
| *F21S 41/255* | (2018.01) |
| *F21S 41/33* | (2018.01) |
| *F21S 41/36* | (2018.01) |
| *F21S 41/43* | (2018.01) |

(52) U.S. Cl.

CPC ..... *F21S 45/47* (2018.01); *F21S 41/14* (2018.01); *F21S 41/16* (2018.01); *F21S 41/192* (2018.01); *F21S 45/43* (2018.01); *F21S 41/255* (2018.01); *F21S 41/333* (2018.01); *F21S 41/36* (2018.01); *F21S 41/43* (2018.01); *F21Y 2115/30* (2016.08)

(58) Field of Classification Search

CPC ..... F21S 45/47; F21S 41/19

See application file for complete search history.

(56) References Cited

U.S. PATENT DOCUMENTS 6,533,620 B2 * 3/2003 Franzen ..... H01R 43/0221 219/121.64

2005/0180157 A1 * 8/2005 Watanabe ..... F21V 19/004 362/543

(Continued)

FOREIGN PATENT DOCUMENTS

JP 2006-278361 A 10/2006

*Primary Examiner* — Andrew J Coughlin

(74) *Attorney, Agent, or Firm* — Osha Liang LLP

(57) ABSTRACT

A light source module has a heat radiating member that has heat radiating properties and has a through-hole penetrating therethrough, a heat generating component having a heat generating component main body disposed on a side of a first opening of the through-hole, and a pin terminal connected to the heat generating component main body and inserted through the through-hole, an electrically conductive member disposed on a side of a second opening of the through-hole and connected to the pin terminal protruding from the second opening, and a covering material that covers and fixes at least a portion of the electrically conductive member and the heat radiating member. A connection portion of the electrically conductive member with the pin terminal is not covered by the covering material.

8 Claims, 7 Drawing Sheets

(56) References Cited

U.S. PATENT DOCUMENTS

| | | | | |
|---|---|---|---|---|
| 2012/0287602 | A1* | 11/2012 | Urano | F21S 4/20<br>362/84 |
| 2015/0103552 | A1* | 4/2015 | Aiso | F21S 45/48<br>362/549 |
| 2015/0211725 | A1* | 7/2015 | Ikuta | F21S 41/192<br>362/382 |
| 2017/0167689 | A1* | 6/2017 | Yagi | F21S 41/192 |

* cited by examiner

LIGHT SOURCE MODULE AND LAMP USING THE SAME

BACKGROUND

Technical Field

The present invention relates to a light source module and a lamp using the same.

Related Art

Lamps are known in which a light source module is used that has a structure including, for example, a light emitting component, namely a semiconductor laser package, disposed on an interconnection substrate, and a heat radiating member made from metal interposed therebetween (see Patent Literature 1 below).

The semiconductor laser package described in Patent Literature 1 below includes a base, namely a stem. The stem is pressed into and fixed to a hole in a heat sink, which is made from metal and is disposed on one face of a circuit board. A laser element is mounted on the stem and a tubular cap is provided on the stem so as to surround the laser element. Rod-like lead terminals are connected to the laser element, and the lead terminals are inserted into holes penetrating the interconnection substrate in a thickness direction and fixed to an interconnect pattern of the interconnection substrate.

Patent Literature 1: Japanese Unexamined Patent Application Publication No. 2006-278361A

SUMMARY

However, with the light source module of Patent Literature 1 above, the stem positioned on one end side of the semiconductor laser package is fixed to the heat sink made from metal, and the lead terminals positioned on the other end side of the semiconductor laser package are fixed to the interconnection substrate. In cases where the heat sink expands due to heat or the like produced by the semiconductor laser package, a force tends to act on the lead terminals of the semiconductor laser package that pulls in a longitudinal direction of the lead terminals. In cases where this pulling force acts on the lead terminals, there is a concern for electrification failure occurring between the lead terminals and the circuit pattern of the circuit board.

One or more embodiments of the present invention provides a light source module whereby electrification failures can be reduced, and a lamp using the same.

A light source module according to one or more embodiments of the present invention includes a heat radiating member with heat radiating properties; a heat generating component including a heat generating component main body disposed on a first opening side of a through-hole penetrating the heat radiating member, and a pin terminal connected to the heat generating component main body and inserted through the through-hole; an electrically conductive member disposed on a second opening side of the through-hole and connected to the pin terminal protruding from the second opening; and a covering material covering and fixing at least a portion of the electrically conductive member and the heat radiating member. In such a light source module, a connection portion of the electrically conductive member with the pin terminal is not covered by the covering material.

With such a light source module, the connection portion of the electrically conductive member with the pin terminal is not covered by the covering material, and at least a portion of the electrically conductive member other than the connection portion is fixed to the heat radiating member by the covering material.

As such, compared to cases where the connection portion of the pin terminal with the electrically conductive member is covered by a covering material, when a force is applied to the pin terminal that pulls in a longitudinal direction of the pin terminal, the load applied to the connection portion in accordance with that force can be reduced.

Accordingly, with the light source module according to one or more embodiments of the present invention, occurrences of electrification failure between the pin terminal and the electrically conductive member can be reduced.

Additionally, according to one or more embodiments of the present invention, the electrically conductive member has elasticity, and the electrically conductive member in the connection portion intersects the pin terminal.

According to such a configuration, when a force is generated at the pin terminal that pulls in the longitudinal direction of the pin terminal, the electrically conductive member elastically deforms so as to flex in the longitudinal direction of the pin terminal. Thus, the force generated at the pin terminal can be absorbed. Accordingly, occurrences of electrification failure between the pin terminal and the electrically conductive member can be further reduced.

Additionally, according to one or more embodiments of the present invention, a portion of the heat radiating member including the second opening of the through-hole is an exposed portion, exposed without being covered by the covering material, a heat conducting member with heat conductivity higher than heat conductivity of air is disposed between the exposed portion and the connection portion, and the heat conducting member is in contact with the exposed portion.

According to such a configuration, the heat generated in the heat generating component main body and transferred to the pin terminal connected to the heat generating component main body is transferred by the heat conducting member to the heat radiating member, and can be radiated from the heat radiating member. Accordingly, even if heat is generated in the heat generating component main body, the force generated at the pin terminal that pulls in the longitudinal direction of the pin terminal is further reduced.

A configuration is possible in which the heat conducting member is a composite member including a resin and electrically insulating particles dispersed in the resin.

Additionally, according to one or more embodiments of the present invention, the electrically conductive member includes a power supply member having a tubular shape and a bus bar connected to the power supply member, at least an outer circumferential surface of the power supply member is covered by the covering material, and a first opening of the power supply member is disposed on a surface of the covering material, and the pin terminal is inserted into inner space of the power supply member from a side of the first opening of the power supply member, and the bus bar and the pin terminal are connected.

According to such a configuration, cracking and the like of the power supply member will be less likely to occur as a result of the force generated at the pin terminal that pulls in the longitudinal direction of the pin terminal. Accordingly, occurrences of electrification failure between the pin terminal and the bus bar can be further reduced compared to a case where the pin terminal and the bus bar are fixed using solder. In addition, the pin terminal and the bus bar can be connected via the power supply member by a simple operation of inserting the pin terminal into the power supply member. Thus, there is no need to weld or adhere the pin terminal and the bus bar to each other and assembly costs of the light source module can be reduced compared to a case where such welding or adhering is performed.

Additionally, according to one or more embodiments of the present invention, the power supply member includes a small diameter portion that become an inner circumferential surface with an inner diameter smaller than an outer diameter of the pin terminal, and the pin terminal inserted into the inner space of the power supply member is pressed upon by the small diameter portion.

According to such a configuration, the pin terminal falling out of the power supply member as a result of the force generated at the pin terminal that pulls in the longitudinal direction of the pin terminal is suppressed. Accordingly, occurrences of electrification failure between the pin terminal and the electrically conductive member can be further reduced.

A light source module according to one or more embodiments of the present invention may reduce electrification failures. According to one or more embodiments of the present invention, a lamp employs a light source module according to one or more embodiments of the present invention.

DETAILED DESCRIPTION

Hereinafter, embodiments of the present invention are described with reference to the attached drawings. The following embodiments are for the intent of facilitating understanding of the present invention, and should not be construed to limit the present invention. Various modifications and improvements may be implemented without departing from the spirit of the present invention. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
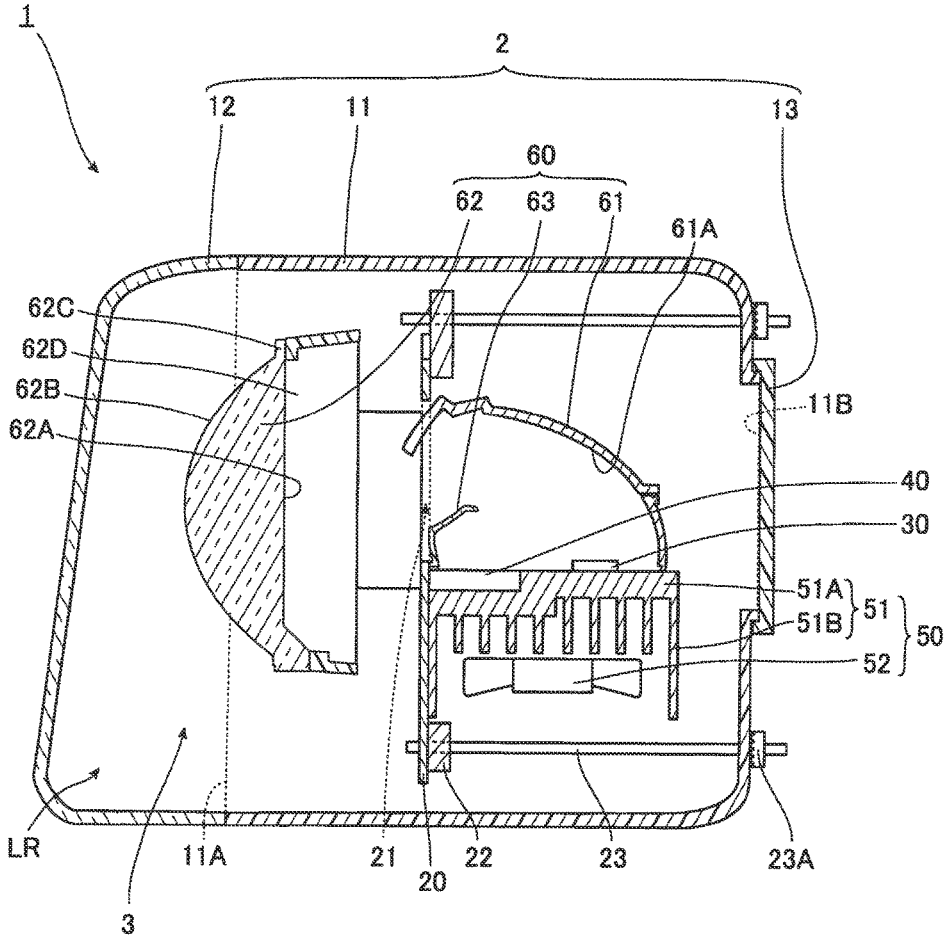
FIG. 1 is a cross-sectional view illustrating an overview of a lamp according to one or more embodiments of the present invention.

FIG. 1 is a cross-sectional view illustrating an overview of a lamp according to one or more embodiments of the present invention. As illustrated in FIG. 1, a lamp 1 according to one or more embodiments of the present invention is a lamp for use in an automobile, specifically an automobile head lamp to be disposed on the front of an automobile. The lamp 1 includes a housing 2, and a lamp unit 3 housed within the housing.

Housing 2

The housing 2 includes a lamp housing 11, a front cover 12, and a back cover 13 as main constituents. An opening 11A is defined in the front of the lamp housing 11, and the front cover 12 is fixed to the lamp housing 11 so as to block the opening 11A. Additionally, an opening 11B that is smaller than the front is defined in the rear of the lamp housing 11, and the back cover 13 is fixed to the lamp housing 11 so as to block the opening 11B.

Space defined by the lamp housing 11, the front cover 12 that blocks the front opening of the lamp housing 11, and the back cover 13 that blocks the rear opening 11B of the lamp housing 11 is a lamp room LR and, the lamp unit 3 is housed within the lamp room LR.

Lamp Unit 3

The lamp unit 3 includes a base plate 20, a light source module 30, a light control unit 40, a heat radiating unit 50, and an optical unit 60 as main constituents.

The base plate 20 is a plate-like member made from metal, and is fixed to the lamp housing 11 of the housing 2. The base plate 20 includes an opening 21 penetrating the base plate 20. The opening 21 is disposed on the light path on which light emitted from the light source module 30 travels. In one or more embodiments of the present invention, the opening 21 is substantially parallel to the opening plane of the opening 11A provided on the front of the lamp housing 11.

Additionally, a bracket 22 is joined to the base plate 20. A plurality of optical axis adjustment screws 23 is screwed into the bracket 22, and the bracket 22 is supported by the lamp housing 11. Second ends, namely head portions 23A, of the optical axis adjustment screws 23 are exposed outside the lamp room LR. The bracket 22 is screwed and tilted as a result of the head portion 23A being rotated. Thus, optical axis adjustment of the optical unit 60 in the up, down, left and right directions is possible.

The light source module 30 is a unit configured to emit light for lighting-up the lamp 1. The light control unit 40 is a unit configured to switch the power of the light source module 30 ON and OFF, and adjust the light intensity and the like of the light source module.

The heat radiating unit 50 is a unit configured to radiate heat generated at the light source module 30, The heat radiating unit 50 according to one or more embodiments of the present invention includes a heat sink 51 and a cooling fan 52 as main constituents.

The heat sink 51 includes a base plate 51A made from metal, and a plurality of heat radiating fins 515 provided integrally with the base plate 51A on one surface side of the base plate 51A. The light source module 30 and the light control unit 40 are mounted on the surface of the base plate 51A, on the side opposite the side where the heat radiating fins 51B are provided; and the light source module 30 and the light control unit 40 are fixed to the base plate 51A. The cooling fan 52 is disposed with a gap with the heat radiating fins 51B, and is fixed to the heat sink 51.

With the heat radiating unit 50 according to one or more embodiments of the present invention, heat emitted by the light source module 30 and the light control unit 40 is transferred from the base plate 51A to the heat radiating fins 51B, and the heat radiating fins 51B are cooled by the cooling fan 52. As a result, with the heat radiating unit 50 according to one or more embodiments of the present invention, the heat of the light source module 30 and the light control unit 40 is efficiently radiated.

The optical unit 60 is a unit configured to handle light emitted from the light source module 30. The optical unit 60 according to one or more embodiments of the present invention includes, for example, a reflector 61, a projection lens 62, and a shade 63 as main constituents.

The reflector 61 is made from a plate material with a curved shape, and is fixed to the base plate 51A of the heat sink 51 so as to cover the light source module 30. A face of the reflector 61 that faces the light source module 30 is a reflecting face 61A. The reflecting face 61A is fundamentally a rotary ellipsoidal curved surface and, of a first focal point and a second focal point of the ellipsoidal curved surface, the light source module 30 is disposed at a position of the first focal point or at a position near the first focal point. At least a portion of the light emitted from the light source module 30 is reflected to the projection lens 62 side by the reflecting face 61A.

The projection lens 62 is an aspherical plano-convex lens. With the projection lens 62, a face on the side where the light emitted from the light source module 30 enters, namely an entrance face 62A, has a flat shape; and a surface on the side from which the light is emitted, namely an exit face 62B, has a convex shape that bulges in an emission direction. In the present embodiment, the projection lens 62 is disposed such that a rear focal point of the projection lens 62 is positioned at or near the second focal point of the reflecting face 61A of the reflector 61. That is, a projector ellipsoid system (PES) optical system is used in the lamp unit 3 according to one or more embodiments of the present invention.

A flange 62C is formed on the periphery of the projection lens 62, and the flange 62C is welded to one end of a lens holder 62D. An end of the lens holder 62D on the side opposite the projection lens 62 side is fixed to the base plate 20 by screw fastening or the like, thereby holding the projection lens 62.

The shade 63 is a member configured to block a portion of the light emitted from the light source module 30. The shade 63 is fixed to the base plate 20 so that a leading end of the shade 63 is positioned at the second focal point or near the second focal point. The shade 63 is irradiated with a portion of the light emitted from the light source module 30 and reflected by the reflector 61. This portion of the light is blocked by the shade 63 and does not enter the projection lens 62. Other portions of the light either are not blocked by the leading end portion of the shade 63 and continue in a straight manner, or reflect at the leading end portion of the shade 63 and enter the projection lens 62. As a result, the light emitted from the projection lens 62 forms a light distribution in which the shape of the leading portion of the shade 63 is reflected.

With the optical unit 60 according to one or more embodiments of the present invention, as described above, the projection lens 62 is fixed to the base plate 20 via the lens holder 62D, and the shade 63 is fixed to the base plate 20. As such, relative positions of the projection lens 62 and the shade 63 can be accurately determined. Additionally, with the optical unit 60 according to one or more embodiments of the present invention, the reflector 61 and the light source module 30 are also fixed to the base plate 20 via the heat radiating unit 50. As such, relative positions of each of the light source module 30, the reflector 61, the shade 63, and the projection lens 62 can be accurately determined. Accordingly, it is possible to accurately predict the light path of the light emitted from the light source module 30 and that enters the projection lens 62 via the shade 63. Note that above, an example of a configuration was given in which the shade 63 is fixed, but, for example, the shade 63 may be movable. In this case, it is possible to change the light distribution pattern by controlling the movement of the shade 63 using, for example, the light control unit 40.

Light Source Module 30

Figure 2:
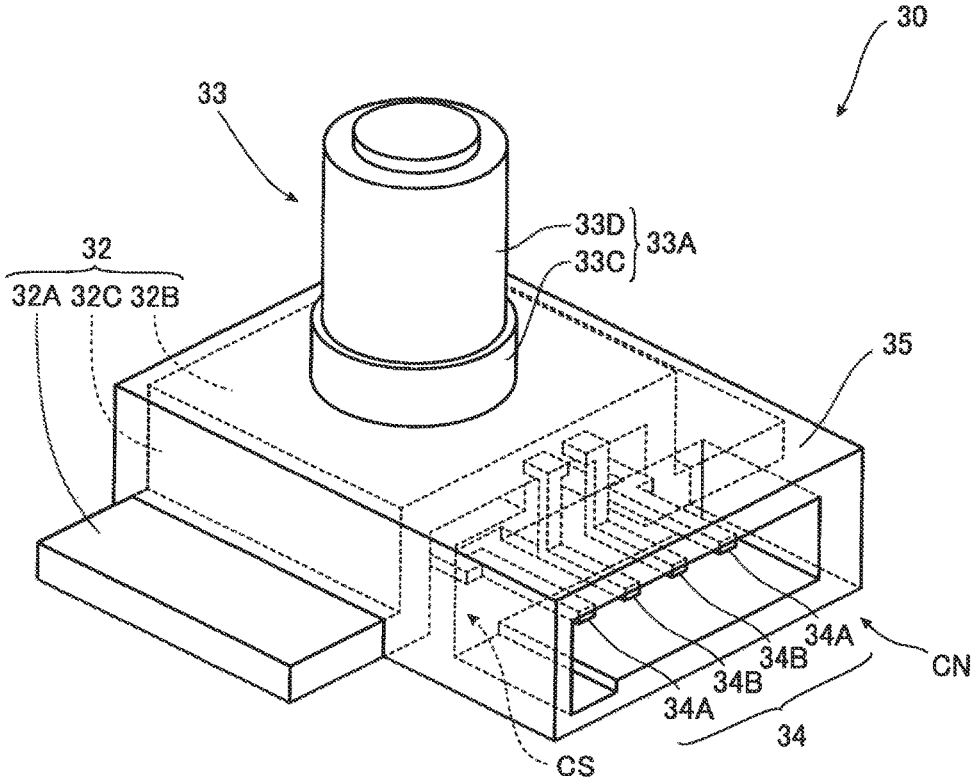
FIG. 2 is a perspective view illustrating an overview of an appearance of a light source module.
Figure 3:
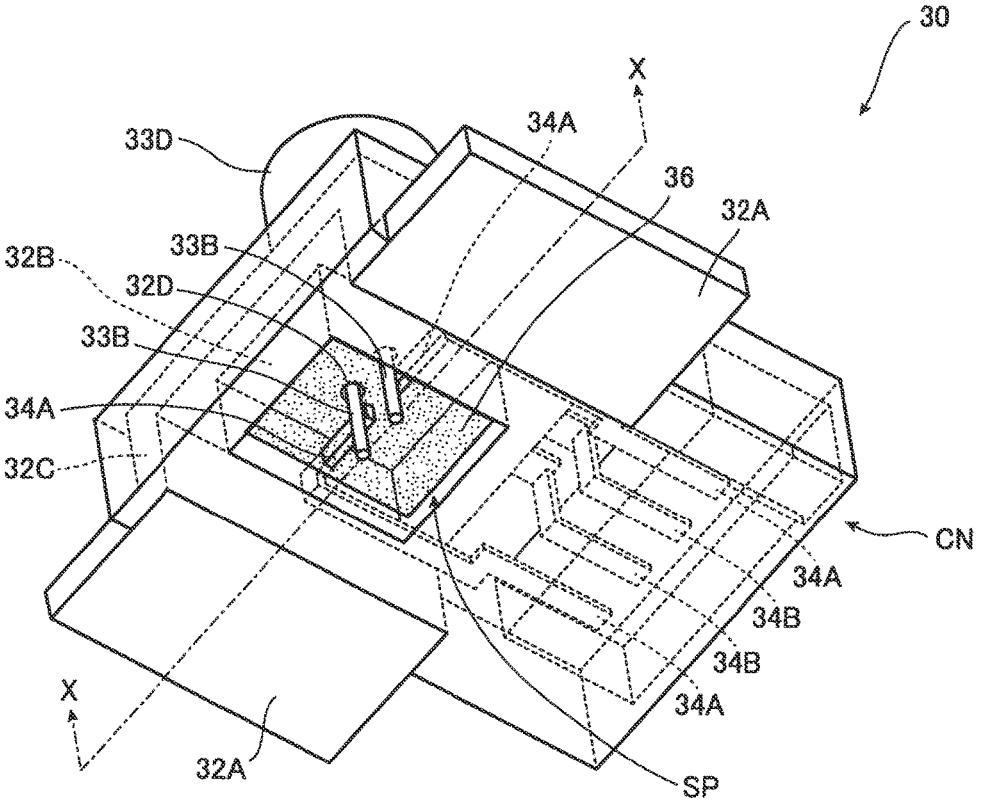
FIG. 3 is a perspective view illustrating an overview of the light source module of FIG. 2, when viewed from a bottom side.
Figure 4:
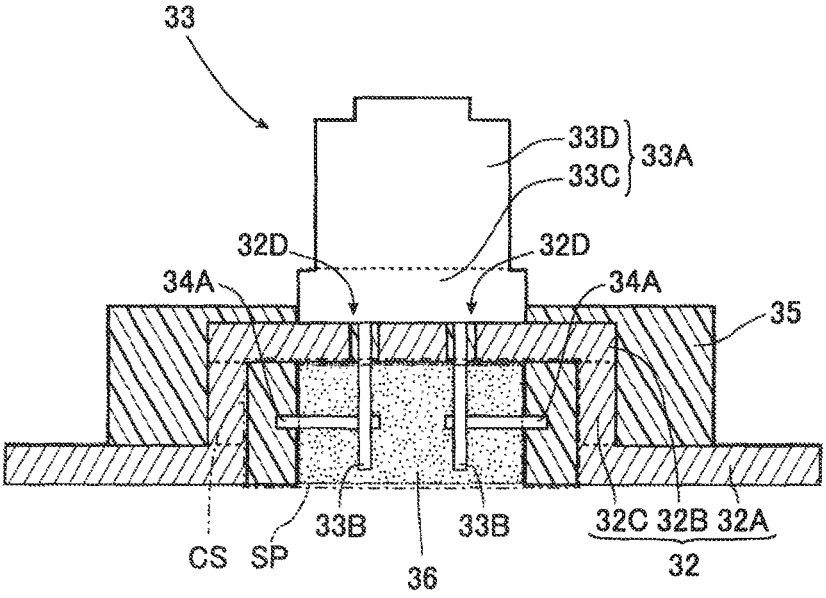
FIG. 4 is a drawing illustrating a cross-section taken along line X-X of FIG. 3.

FIG. 2 is a perspective view illustrating an overview of an appearance of the light source module 30. FIG. 3 is a perspective view illustrating an overview of the light source module 30 of FIG. 2, when viewed from the bottom side. FIG. 4 is a drawing illustrating a cross-section taken along line X-X of FIG. 3.

As illustrated in FIGS. 2 to 4, the light source module 30 according to one or more embodiments of the present invention includes a heat radiating member 32, a light emitting component 33, a bus bar 34, a covering material 35, and a heat conducting member 36 as main constituents. Note that in FIGS. 2 and 3, portions indicated by the broken lines are portions covered by the covering material 35.

The heat radiating member 32 is a member configured to radiate heat generated at the light emitting component 33, and has expansivity whereby the volume thereof expands in accordance with increases in temperature. The heat radiating member 32 according to one or more embodiments of the present invention is formed using a thermally conductive material such as aluminum or a similar metal, a ceramic, or the like, and conducts heat primarily to the heat sink 51 (FIG. 1).

The heat radiating member 32 includes a lower portion 32A, an upper portion 32B, and a middle portion 32C. The lower portion 32A is a portion mounted on the heat sink 51 (FIG. 1), and the upper portion 32B is a portion on which a portion of the light emitting component 33 is mounted. The middle portion 32C is a portion positioned between the lower portion 32A and the upper portion 32B and provides a step between the lower portion 32A and the upper portion 32B. In one or more embodiments of the present invention, a pair of the middle portions 32C is provided so as to face each other across a spacing. Space surrounded by the middle portions 32C and the upper portion 32B constitutes configuration space CS where portions of the light emitting component 33 and the bus bar 34 are disposed.

Through-holes 32D penetrating the upper portion 32B in a thickness direction of the upper portion 32B are provided in the upper portion 32B. Openings whereby the configuration space CS communicates with outside of the heat radiating member 32 are defined in the lower portions 32A, in regions corresponding to lower sides of the through-holes 32D in the upper portion 32B.

The light emitting component 33 includes a light emitting component main body 33A and pin terminals 33B connected to the light emitting component main body 33A and, in one or more embodiments of the present invention, is configured as a CAN package.

The light emitting component main body 33A includes a stem 33C and a cap 33D, and is disposed on a first opening side of the through-holes 32D provided in the upper portion 32B of the heat radiating member 32. The stem 33C is a pedestal made from metal, and is disposed on a surface of the side of the upper portion 32B of the heat radiating member 32 opposite the surface of the configuration space CS side. The cap 33D is a box member made from metal, and is provided on a surface of the side of the stem 33C opposite the surface facing the upper portion 32B. A light emitting element (not illustrated) is housed in inner space defined by the stem 33C and the cap 33D. The light emitting element is, for example, a semiconductor laser element, and a peak wavelength of light emitted from this semiconductor laser element is, for example, from 380 to 500 nm. At least two of the pin terminals 33B, namely a pin terminal 33B serving as the anode and a pin terminal 33B serving as a cathode, are connected to the light emitting element.

Note that a light wavelength conversion member that absorbs a portion of the light and converts it to a long wavelength may be disposed in the inner space defined by the stem 33C and the cap 33D, within the path of the light emitted by the light emitting element. In cases where such a light wavelength conversion member is disposed, it is possible to emit the light emitted from the light emitting element and mixed color light from the light converted by the light wavelength conversion member. The light wavelength conversion member may, for example, be fixed to the stem 33C, and a specific example of the light wavelength conversion member is a YAG phosphor.

The pin terminals 33B are fixed to the stem 33C in state electrically insulated from the stem 33C, and are inserted through the through-holes 32D in the upper portion 32B of the heat radiating member 32. Note that a tubular electrical insulation member 37 is provided between the through-holes 32D in the heat radiating member 32 and the pin terminals 33B. The electrical insulation member 37 is fixed to the heat radiating member 32 in a state contacting inner circumferential surfaces of the through-holes 32D in the heat radiating member 32 and the outer circumferential surfaces of the pin terminals 33B. Shorting of the pin terminal 33B serving as the anode and the pin terminal 33B serving as the cathode by the heat radiating member 32 is prevented by the electrical insulation member 37.

The bus bar 34 is a rod-like electrically conductive member that transmits electrical current supplied from a power supply, and has elasticity. Note that a cross-sectional shape in a direction orthogonal to the longitudinal direction of the bus bar 34 may be round or rectangular. In one or more embodiments of the present invention, a pair of pin terminal bus bars 34A for transmitting electrical current to the pin terminal 33B serving as the anode and the pin terminal 33B serving as the cathode, and a pair of thermistor bus bars 34B for transmitting electrical current to a thermistor (not illustrated) are provided.

The pair of pin terminal bus bars 34A is disposed on a second opening side of the through-holes 32D in the heat radiating member 32. A first end side of these bus bars 34A are connected by solder, welding, or the like to the pin terminals 33B protruding from the second opening side into the configuration space CS; and leading end portions of a second end side of these bus bars 34A protrude from the configuration space CS of the heat radiating member 32. Additionally, the pair of pin terminal bus bars 34A is disposed in a direction orthogonal to the longitudinal direction of the pin terminals 33B, in a state facing each other from the first ends to the leading ends thereof.

The pair of thermistor bus bars 34B is disposed to the side of the configuration space CS without being disposed in the configuration space CS of the heat radiating member 32. A first end side of these bus bars 34B is fixed to a side surface of the upper portion 32B of the heat radiating member 32; and leading end portions of a second end side of the bus bars 34B are disposed between the pin terminal bus bars 34 protruding from the configuration space CS of the heat radiating member 32. Additionally, the pair of thermistor bus bars 34B includes a step between a first end and a leading end thereof, and at least the leading end portions of the bus bars 34 are disposed in a direction orthogonal to the longitudinal direction of the pin terminals 33B.

The leading end portions of the four bus bars 34 are positioned above the surface of the lower portion 32A of the heat radiating member 32 that faces the upper portion 32B, and are aligned on the same plane at a set spacing in the direction orthogonal to the longitudinal direction of the leading end portions of the bus bars 34.

The covering material 35 is a member made from resin that covers and fixes a portion of the bus bars 34 and the heat radiating member 32; and is molded so as to integrate the heat radiating member 32 and the bus bars 34. Examples of the material of the covering material 35 include polycarbonate, polyethylene terephthalate, and the like.

The covering material 35 covers all of the upper portion 32B and the middle portion 32C of the heat radiating member 32 and penetrates into the configuration space CS of the heat radiating member 32, but a portion of the configuration space CS, namely space SP, is left uncovered. This space SP is a portion where the pin terminals 33B protruding from the through-holes 32D in the heat radiating member 32 into the configuration space CS are positioned, and surrounding portions thereof; and include connection portions of the pin terminals 33B with the pin terminal bus bars 34A. Specifically, the surroundings of the pin terminals 33B protruding from the second opening side, namely the space SP side, of the through-holes 32D on the lower side of the upper portion 32B of the heat radiating member 32 is the space SP; and the connection portions of the pin terminals 33B with the bus bars 34 are not covered by the covering material 35. The bus bars 34 at the connection portions intersect the pin terminals 33B. Note that the bus bars 34 at the connection portions also intersect the pin terminals 33B in cases where the leading end portions of the bus bars 34 are connected to the pin terminals 33B in a state where extended in the direction crossing the longitudinal direction of the pin terminals 33B.

Additionally, the covering material 35 includes an opening whereby the space SP communicates with the portions surrounding the openings of the through-holes 32D on the configuration space CS side of the upper portion 32B of the heat radiating member 32, and a portion of the upper portion 32B is exposed to the space SP via this opening. Specifically, a portion, including the openings of the through-holes 32D, that is the space SP side of the upper portion 32B of the heat radiating member 32, is an exposed portion that is exposed, and is not covered by the covering material 35. Note that space between this exposed portion and the connection portions of the pin terminals 33B with the bus bars 34 is a part of the space SP.

A connector CN is formed to the side of the heat radiating member 32 by the covering material 35 described above. Specifically, the connector CN is formed by surrounding the leading end portions of the pin terminal bus bars 34A and the thermistor bus bars 34B protruding from the configuration space CS of the heat radiating member 32 and the surroundings of the leading end portions with the covering material 35.

The heat conducting member 36 is a member configured to radiate heat generated at the light emitting component 33, and has heat conductivity higher than the heat conductivity of air. The heat conducting member 36 is disposed in the space SP defined by the covering material 35, and is in contact with the exposed portion of the heat radiating member 32 that is exposed to the space SP. In one or more embodiments the present invention, the space SP defined by the covering material 35 is filled without gaps with the heat conducting member 36. The heat conducting member 36 of according to one or more embodiments of the present invention is a viscous material, e.g., grease.

As described above, with the light source module 30 according to one or more embodiments of the present invention, the pin terminal bus bars 34 are used, and at least a portion of the bus bars 34 and the heat radiating member 32 through which the pin terminals 33B that connect to the bus bars 34 are inserted is covered and fixed by the covering material 35. On the other hand, the connection portions of the bus bars 34 with the pin terminals 33B protruding from the openings on the side opposite the light emitting component main body 33A of the through-holes 32D in the heat radiating member 32, are not covered by the covering material 35.

Specifically, the connection portions of the pin terminal bus bars 34A with the pin terminals 33B are not covered by the covering material 35, and portions of the bus bars 34A other than the connection portions are fixed to the heat radiating member 32 by the covering material 35.

As such, compared to cases where the connection portions of the bus bars 34A with the pin terminals 33B are covered by the covering material 35, when a force is applied to the pin terminals 33B that pulls in the longitudinal direction of the pin terminals 33B, the load applied to the connection portions in accordance with that force can be reduced.

Accordingly, with the light source module 30 according to one or more embodiments of the present invention, even if heat is generated in the light emitting component main body 33A and a force is generated in the pin terminals 33B that pulls in the longitudinal direction of the pin terminals 33B, occurrences of electrification failure between the pin terminals 33B and the pin terminal bus bars 34A are reduced.

Additionally, the pin terminal bus bars 34A according to one or more embodiments of the present invention have elasticity and extend in a direction intersecting the pin terminals 33B.

Figure 5:
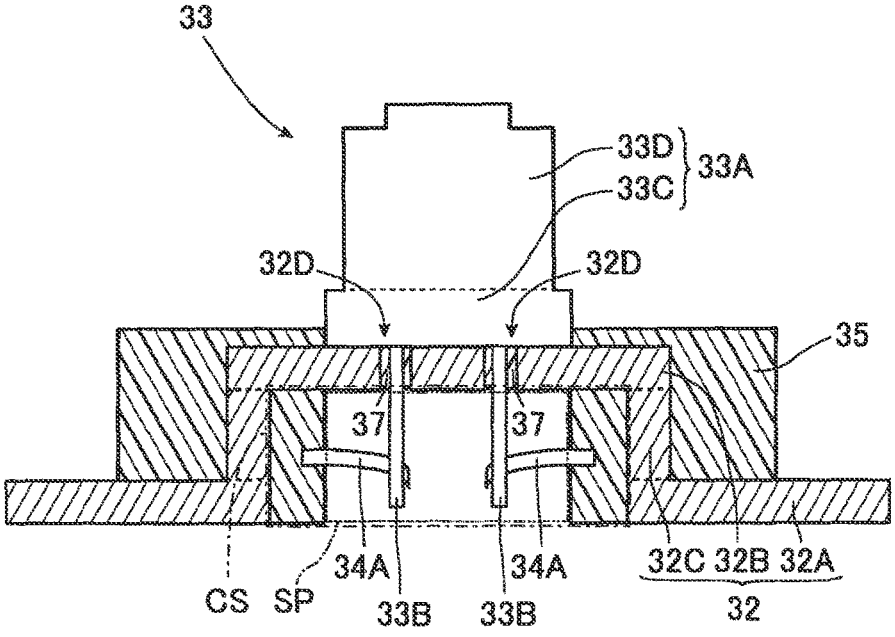
FIG. 5 is a drawing illustrating an overview of a situation of a case where a force pulling a pin terminal is generated.

As such, in cases where a force is generated at the pin terminals 33B that pulls in the longitudinal direction of the pin terminals 33B, as illustrated in FIG. 5, the pin terminal bus bars 34A elastically deform so as to flex in the longitudinal direction of the pin terminals 33B. Thus, the force generated at the pin terminals 33B can be absorbed. Accordingly, occurrences of electrification failure between the pin terminals 33B and the pin terminal bus bars 34A are reduced.

Additionally, of the heat radiating member 32 according to one or more embodiments of the present invention, the portion including the opening on the side of the through-holes 32D opposite the side of the light emitting component main body 33A is configured as the exposed portion that is not covered by the covering material 35 and is exposed. The space between the exposed portion and the connection portion of the pin terminal bus bars 34A with the pin terminals 33B is a portion of the space SP, and the heat conducting member 36 that has heat conductivity higher than the heat conductivity of air is disposed in the space SP. The heat conducting member 36 is in contact with the exposed portion of the heat radiating member 32 that is exposed to the space SP of the covering material 35.

As such, the heat generated in the light emitting component main body 33A and transferred to the pin terminals 33B connected to the light emitting component main body 33A is transferred by the heat conducting member 36 to the heat radiating member 32, and can be radiated from the heat radiating member 32. Accordingly, even if heat is generated in the light emitting component main body 33A, the force generated at the pin terminals that pulls in the longitudinal direction of the pin terminals 33B is further reduced. Note that the heat radiating member 32 according to one or more embodiments of the present invention is mounted on the heat sink 51, and the heat conducting member 36 disposed in the space SP of the covering material 35 covering a portion of the heat radiating member 32 is also in contact with the heat sink 51. As such, compared to a case where the heat conducting member 36 is not W present, the amount of heat conduction of the heat generated in the light emitting component main body 33A and conducted to the heat sink 51 can be significantly increased.

Modified Examples

In one or more the embodiments described above, a portion of the heat radiating member 32 is covered by the covering material 35. However, provided that the covering material 35 does not cover at least the connection portions of the pin terminals 33B with the bus bars 34A, the entire heat radiating member 32 may be covered.

In one or more of the embodiments described above, the pin terminal bus bars 34A are disposed in a direction orthogonal to the longitudinal direction of the pin terminals 33B, from the first ends to the leading ends thereof. However, the pin terminal bus bars 34A need not be disposed in the direction orthogonal to the longitudinal direction of the pin terminals 33B. Regardless, in order for the pin terminal bus bars 34A to flex in the longitudinal direction of the pin terminals 33B and absorb the force generated in the pin terminals 33B as illustrated in FIG. 5, according to one or more embodiments of the present invention, the pin terminal bus bars 34A extends in the intersecting direction at the connection portions with the pin terminals 33B.

In one or more of the embodiments described above, of the surface on the configuration space CS side of the heat radiating member 32, only the portions surrounding the openings of the through-holes 32D in the heat radiating member 32 are exposed to the space SP of the covering material 35. However, the entire surface on the configuration space CS of the heat radiating member 32 may be exposed to the space SP of the covering material 35, or the heat radiating member 32 may not be exposed to the space SP. Regardless, in order to increase the amount of heat conduction as described above, according to one or more embodiments of the present invention, of the heat radiating member 32, the portions including the second openings of the through-holes 32D are configured as the exposed portions and be exposed without being covered by the covering material 35.

In one or more of the embodiments described above, the heat conducting member 36 is grease. However, the heat conducting member 36 may be a single resin or, as illustrated in FIG. 6, may be a composite member including a resin 36A and electrically insulating particles 36B dispersed in the resin 36A.

Figure 6:
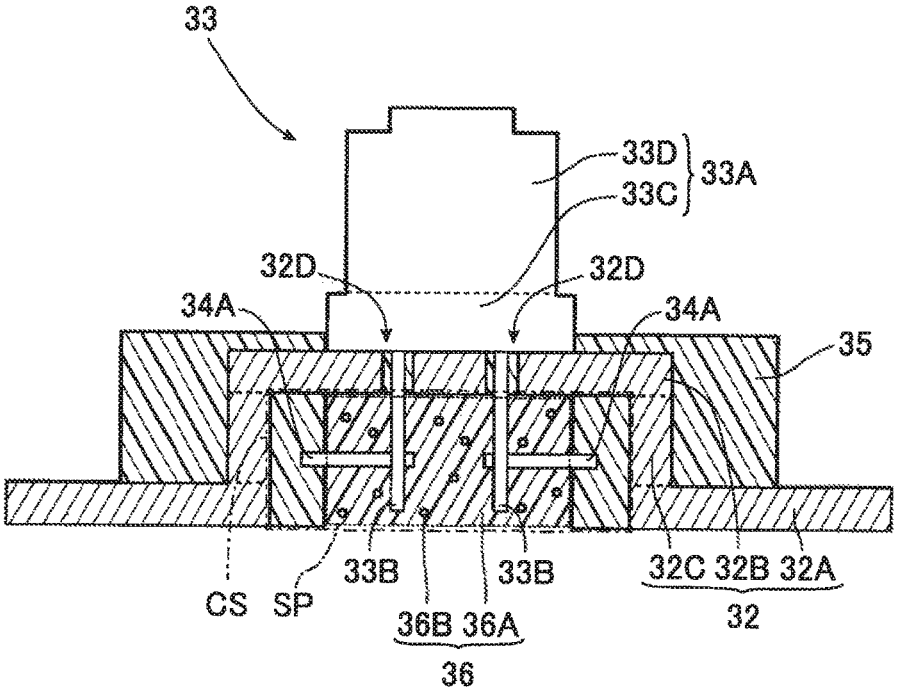
FIG. 6 is a cross-sectional view illustrating an overview of a light source module according to one or more embodiments of the present invention.

FIG. 6 is a cross-sectional view illustrating an overview of a light source module according to one or more embodiments of the present invention. According to one or more embodiments of the present invention, the resin 36A of the heat conducting member 36 in the light source module illustrated in FIG. 6 has a modulus of elasticity lower than that of the covering material 35. Compared to cases where the modulus of elasticity of the resin 36A is about the same as the modulus of elasticity of the covering material 35, in cases where the modulus of elasticity of the resin 36A is lower than the modulus of elasticity of the covering material 35, decreases in the elastic deformation of the pin terminal bus bars 34A can be suppressed. For example, in a case where the material of the covering material 35 is polycarbonate, the material of the resin of the heat conducting member 36 may be a silicone resin or the like. Additionally, examples of materials of the particles 36B include alumina, silica, and metal oxides.

Note that in cases where the heat conducting member 36 is a composite member of the resin 36A and the particles 36B, the term "thermal conductivity" means the average thermal conductivity of the composite member and does not refer to the individual thermal conductivities of the resin 36A and the particles 36B.

In one or more of the embodiments described above, shorting of the pin terminal 33B serving as the anode and the pin terminal 33B serving as the cathode by the heat radiating member 32 is prevented by the electrical insulation member 37. However, as illustrated in FIG. 6, the electrical insulation member 37 may be omitted, and the space between the through-holes 32D in the heat radiating member 32 and the pin terminals 33B may be filled with the covering material 35. That is, by introducing the covering material 35 between the through-holes 32D in the heat radiating member 32 and the pin terminals 33B, shorting of the pin terminal 33B serving as the anode and the pin terminal 33B serving as the cathode by the heat radiating member 32 is prevented. According to such a configuration, the number of components can be reduced by an amount equal to the omittable amount of the electrical insulation member 37.

In one or more of the embodiments described above, pin terminal bus bars 34A are used as the electrically conductive members connected to the pin terminals 33B. However, as illustrated in FIG. 7, the electrically conductive members may include tubular power supply members 90 and pin terminal bus bars 34A connected to the power supply members 90.

Figure 7:
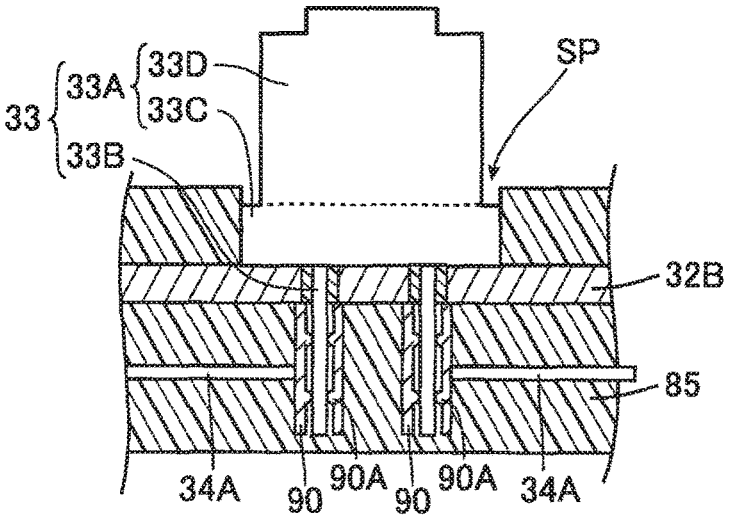
FIG. 7 is a cross-sectional view illustrating an overview of a light source module according to one or more embodiments of the present invention.

FIG. 7 is a cross-sectional view illustrating an overview of a light source module according to one or more embodiments of the present invention. With the light source module illustrated in FIG. 7, a covering material 85 is used that covers and fixes the heat radiating member 32 and the pin terminal bus bars 34A and also at least the outer circumferential surface of the tubular power supply members 90. The covering material 85 is made from a moldable resin capable of integrating the heat radiating member 32, the pin terminal bus bars 34A, and the tubular power supply members 90.

The space SP is defined in the covering material 85 at a different position than in the covering material 35 of one or more of the embodiments described above. Specifically, the space SP of the covering material 35 of the embodiment described above is defined on the side of the upper portion 32B of the heat radiating member 32 of the leading ends of the pin terminals 33B inserted through the through-holes 32D, so as to surround the pin terminals 33B protruding from the through-holes 32D. In contrast, the space SP of the covering material 85 illustrated in FIG. 7 is defined on the side of the upper portion 32B of the heat radiating member 32 of the roots of the pin terminals 33B inserted through the through-holes 32D, so as to surround the light emitting component main body 33A that is linked to the pin terminals 33B.

Additionally, in the covering material 85, the tubular power supply members 90 are provided on the side of the upper portion 32B of the heat radiating member 32 of the leading ends of the pin terminals 33B inserted through the through-holes 32D. A first opening of the power supply member 90 is disposed at a surface of the covering material 85 positioned under the opening on the side of the through-holes 32D of the leading ends of the pin terminals 33B, which are inserted through the through-holes 32D in the heat radiating member 32. The pin terminals 33B are inserted into the inner space of the power supply members 90 from the first opening side of the power supply members 90, and the power supply members 90 are connected to the pin terminal bus bars 34A, which are connected to the outer circumferential surface of the power supply members 90 by solder or the like. Note that a second opening of the power supply members 90 is covered by the covering material 85, but need not be covered and the side under this opening may be configured as space.

With such a light source module, the pin terminals 33B are inserted into the tubular power supply members 90 to which the pin terminal bus bars 34A connect. Thus, the pin terminal bus bars 34A and the pin terminals 33B are connected via the power supply members 90. As such, cracking and the like of the power supply members 90 will be less likely to occur as a result of the force generated at the pin terminals 33B that pulls in the longitudinal direction of the pin terminal 33B. Accordingly, occurrences of electrification failure between the pin terminals 33B and the pin terminal bus bars 34A can be reduced compared to a case where the pin terminals 33B and the pin terminal bus bars 34A are fixed using solder. In addition, the pin terminals 33B and the pin terminal bus bars 34A can be connected via the power supply members 90 by a simple operation of inserting the pin terminals 33B into the power supply members 90. Thus, there is no need to weld or adhere the pin terminals 33B and the pin terminal bus bars 34A to each other and assembly costs of the light source module can be reduced compared to a case where such welding or adhering is performed.

Furthermore, the power supply members 90 include a small diameter portion 90A that becomes an inner circumferential surface with an inner diameter smaller than an outer diameter of the pin terminals 33B; and the pin terminals 33B are pressed upon by the small diameter portion 90A. As such, situations such as the pin terminals 33B falling out of the power supply members 90 as a result of the force generated at the pin terminals 33B that pulls in the longitudinal direction of the pin terminals 33B are suppressed. Accordingly, occurrences of electrification failure between the pin terminals 33B and the pin terminal bus bars 34A are further reduced.

Additionally, in one or more of the embodiments described above, the heat radiating member 32 is configured as a member that is separate from the heat sink 51, but may also be molded as an integral member with the heat sink 51.

Moreover, in one or more of the embodiments described above, the light emitting component 33 that includes the light emitting component main body 33A and the pin terminals 33B is applied as the heat generating component. However, provided that the heat generating component main body and the pin terminals connected to the heat generating component main body are included, the heat generating component is not limited to the light emitting component 33.

Additionally, in one or more of the embodiments described above, the optical unit 60 is constituted from the reflector 61, the projection lens 62, and the shade 63. However, the optical unit 60 is not limited to that described above. For example, a parabolic optical system in which a parabolic reflective surface may be used for the optical unit 60, or a direct optical system in which light is directly projected without using a reflective surface may be used for the optical unit 60.

Additionally, in one or more of the embodiments described above, an automobile head lamp was given as an example of the lamp. However, the lamp is not limited to the embodiments described above. For example, when used in an automobile, the lamp may be applied as a signal lamp such as a tail lamp, or as interior lighting. Additionally, a PES optical system was applied as the optical unit 60, but a parabolic optical system or a mono focus optical system may also be applied. Moreover, the lamp of the present invention may be a lamp used in non-automobile applications.

A light source module according to one or more embodiments of the present invention reduces electrification failures. A lamp according to one or more embodiments comprises a light source module according to one or more embodiments of the present invention, and may be used in the fields of automobile lamps and the like.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

1 Lamp
2 Housing
3 Lamp unit
20 Base plate
30 Light source module
32 Heat radiating member
33 Light emitting component
34 Bus bar
35 Covering material
36 Heat conducting member
40 Light control unit
50 Heat radiating unit
60 Optical unit

The invention claimed is:

1. A light source module, comprising:
a heat radiating member that has heat radiating properties, and that comprises a through-hole penetrating therethrough;
a heat generating component comprising:
a heat generating component main body disposed on a side of a first opening of the through-hole, and
a pin terminal connected to the heat generating component main body and inserted through the through-hole;
an electrically conductive member disposed on a side of a second opening of the through-hole and connected to the pin terminal protruding from the second opening; and
a covering material that covers and fixes at least a portion of the electrically conductive member and the heat radiating member,
wherein a connection portion of the electrically conductive member with the pin terminal is not covered by the covering material,
wherein the electrically conductive member has elasticity, and
wherein the electrically conductive member at the connection portion intersects the pin terminal.

2. The light source module according to claim 1, wherein:
a portion of the heat radiating member including the second opening of the through-hole is an exposed portion, exposed without being covered by the covering material;
a heat conducting member with heat conductivity higher than heat conductivity of air is disposed between the exposed portion and the connection portion; and
the heat conducting member is in contact with the exposed portion.

3. The light source module according to claim 2, wherein:
the heat conducting member is a composite member including a resin different than the covering material and electrically insulating particles dispersed in the resin.

4. The light source module according to claim 1, wherein:
the electrically conductive member includes a power supply member having a tubular shape and a bus bar connected to the power supply member;
at least an outer circumferential surface of the power supply member is covered by the covering material, and a first opening of the power supply member is disposed at a surface of the covering material; and
the pin terminal is inserted into inner space of the power supply member from a side of the first opening of the power supply member and the bus bar and the pin terminal are connected.

5. The light source module according to claim 4, wherein:
the power supply member includes a small diameter portion that becomes an inner circumferential surface with an inner diameter smaller than an outer diameter of the pin terminal; and
the pin terminal inserted into the inner space of the power supply member is pressed upon by the small diameter portion.

6. The light source module according to claim 1, wherein the covering material covers a top surface of the heat radiating member.

7. A light source module, comprising:
a heat radiating member that has heat radiating properties, and that comprises a through-hole penetrating therethrough;
a heat generating component comprising:
a heat generating component main body disposed on a side of a first opening of the through-hole, and
a pin terminal connected to the heat generating component main body and inserted through the through-hole;
an electrically conductive member disposed on a side of a second opening of the through-hole and connected to the pin terminal protruding from the second opening; and
a covering material that covers and fixes at least a portion of the electrically conductive member and the heat radiating member,
wherein a connection portion of the electrically conductive member with the pin terminal is not covered by the covering material, and
wherein the electrically conductive member extends from the pin terminal into the covering material in a direction perpendicular to an insertion direction of the pin terminal.

8. A light source module, comprising:
a heat radiating member that has heat radiating properties, and that comprises a through-hole penetrating therethrough;
a heat generating component comprising:
a heat generating component main body disposed on a side of a first opening of the through-hole, and
a pin terminal connected to the heat generating component main body and inserted through the through-hole;
an electrically conductive member disposed on a side of a second opening of the through-hole and connected to the pin terminal protruding from the second opening; and a covering material that covers and fixes at least a portion of the electrically conductive member and the heat radiating member, wherein a connection portion of the electrically conductive member with the pin terminal is not covered by the covering material, and wherein an insulating member or the covering material is disposed in the through-hole between the pin terminal and the heat radiating member.

* * * * *